US005772169A

United States Patent [19]

Blockley

[11] Patent Number: 5,772,169

[45] Date of Patent: Jun. 30, 1998

[54] COMPRESSION STRUT SYSTEM FOR ACOUSTIC CEILING

[76] Inventor: William Edward Blockley, 1915 Alta Vista Dr., Bakersfield, Calif. 93305

[21] Appl. No.: 743,217

[22] Filed: Nov. 5, 1996

[51] Int. Cl.[6] ..... A47H 1/10

[52] U.S. Cl. ..... 248/333; 52/39; 52/506.06; 248/354.1; 403/365

[58] Field of Search ..... 248/326, 327, 248/354.1, 333; 403/365, 371, 367; 52/506.06, 506.07, 506.08, 506.09, 506.1, 39, 126.5

[56] References Cited

U.S. PATENT DOCUMENTS

| | | | |
|---|---|---|---|
| 481,814 | 8/1892 | Overholt | 248/333 |
| 1,189,044 | 6/1916 | Boden | 248/333 |
| 4,127,252 | 11/1978 | Splawn | 248/333 |
| 4,947,607 | 8/1990 | Stein | 52/506.06 |
| 5,012,624 | 5/1991 | Dahlgren | 52/506.06 |
| 5,118,066 | 6/1992 | Perrault et al. | 248/333 |
| 5,160,107 | 11/1992 | Perrault et al. | 248/327 |
| 5,201,598 | 4/1993 | Tehan | 403/365 X |
| 5,221,064 | 6/1993 | Hodges | 248/333 X |
| 5,315,784 | 5/1994 | Henehan | 248/333 X |
| 5,477,929 | 12/1995 | Kenyon et al. | 403/365 X |

*Primary Examiner*—Beth A. Aubrey
*Attorney, Agent, or Firm*—Joseph H. Golant

[57] ABSTRACT

An acoustic ceiling compression strut system and method to help a suspended office building ceiling withstand an earthquake. The system includes two elongated tubes in a telescoping relationship and an adjustable locking connector placed between the two tubes and having a U-shape with two legs and a base. One tube is placed to abut a deck of the office building while the connector abuts the bottom of the tube. Thereafter, the second tube is lowered to abut a grid and the legs are bent around the top of the second tube thereby locking the two tubes and the connector and causing them to become a rigid strut.

7 Claims, 3 Drawing Sheets

COMPRESSION STRUT SYSTEM FOR ACOUSTIC CEILING

BACKGROUND OF THE INVENTION

1. Field of the Invention

The present invention relates to a compression strut system and method and, more particularly, to a simple and inexpensive compression strut system and a method for installing such a system. The system strengthens acoustic ceilings against earthquake damages.

2. Description Of The Prior Art

In those areas of the country having earthquake activity, the acoustic ceilings typically used in office buildings tend to be easily damaged whenever there is a tremor. Several prior art systems have been attempted in the past to reduce damage. However, they have been proven ineffective or only partially effective in preventing damage to ceilings.

Typically, an office building's acoustic ceiling is constructed of a metal grid suspended by twelve gauge galvanized steel wire from an upper deck. Acoustic panels and lighting fixtures are then set into the grid as desired. As can be appreciated, when an earthquake shakes an office building, there is a tendency for the grid to bounce vertically as well as to twist. Usually, this causes the grid to break away from the walls, and major repair work is required to reinstall the ceiling.

One prior art system consisted of placing wire diagonally in four different directions, called splay bracing. This still allowed the grid to bounce during an earthquake, and thus, was ineffective. Another prior art approach was to use splay bracing and place periodic metal studs between the grid and the upper deck. This provided for a rigid system which prevented bouncing of the grid. However, the system was relatively expensive. Another prior art approach was the use of splay bracing and tubular braces which were nailed to the upper deck and attached to the grid with plastic clips. This system was also expensive and was not usable with all deck materials such as steel. Still another approach was to place tubing around the hanger wire. However, the tube could only extend a portion of the distance between the deck and the grid. About two inches of the hanger wire was left exposed to allow the wire to be tied at its bottom end after connection to the grid. This two inch spacing allowed the grid to bounce vertically and twist during an earthquake and thus was not effective. Finally, another approach was to use splay bracing and two telescoping tubes where the tubes were drilled and screws were used to fix the tubes in position. Once again, the system was expensive because installation was complicated.

The numerous prior attempts to provide reinforcement to prevent movement of the ceiling grid have yet to produce an optimal system.

BRIEF DESCRIPTION OF THE INVENTION

The difficulties encountered by previous systems have been overcome by the present invention. What is described here is an acoustic ceiling compression strut system comprising a first elongated element having means for accommodating a wire; a second elongated element having means for accommodating the first elongated element; and an adjustable connector operable in two modes, a first mode whereby the first and the second elongated elements are movable relative to each other and a second mode whereby the first and the second elongated elements are locked in position relative to one another.

The invention also includes a method for installing an earthquake resistant ceiling comprising the steps of providing a deck; providing a plurality of wires connected to the deck and hanging downwardly; providing a ceiling grid to be attached to the hanging wires; providing a first elongated tube having a length shorter than the predetermined distance between the deck and the grid; providing a second elongated tube having a diameter larger than the first tube; providing a locking connector; placing the first and the second elongated tubes in a telescoping relationship; placing the locking connector between the first and the second elongated tubes; and bending the locking connector to prevent relative movement between the two elongated tubes.

An object of the present invention is to provide a ceiling bracing system that reduces or eliminates earthquake damage to acoustic ceilings. Another object of the present invention is to provide a ceiling bracing method and system for reducing or eliminating earthquake damages to an acoustic ceiling that is effective, relatively inexpensive and easy to use. An aspect of the invention is to provide a ceiling bracing system that is easy to install.

A more complete understanding of the present invention and other objects, aspects, aims and advantages thereof will be gained from a consideration of the following description of the preferred embodiments read in conjunction with the accompanying drawings provided herein.

DESCRIPTION OF THE PREFERRED EMBODIMENTS

Figure 1:
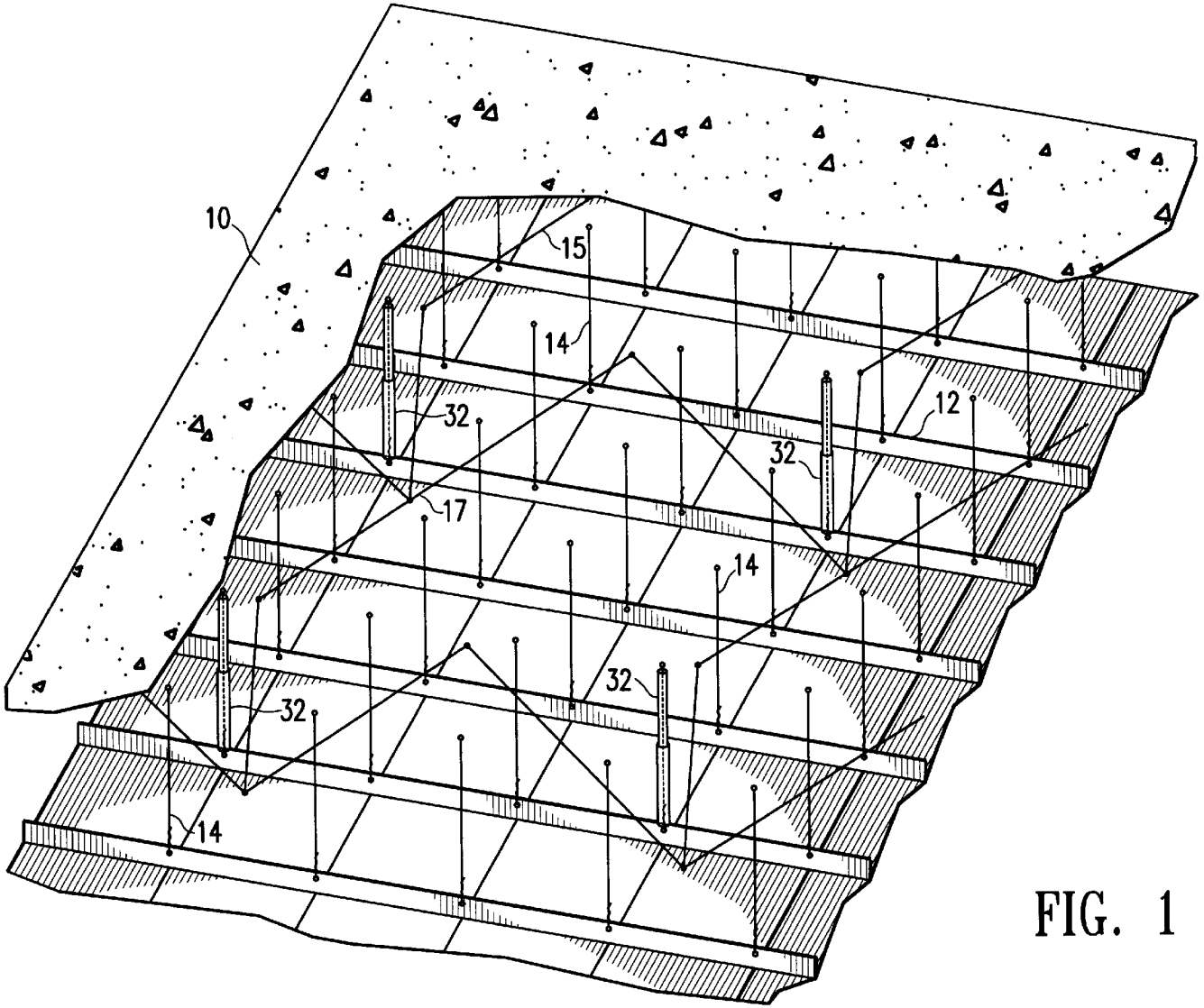
FIG. 1 is a cut away upwardly looking prospective view in diagrammatic form illustrating a deck and suspended grid such as those typically found in a office building.

While the present invention is open to various modifications and alternative constructions, the preferred embodiments shown in the drawings will be described herein in detail. It is to be understood, however, that there is no intention to limit the invention to the particular forms disclosed. On the contrary, the intention is to cover all modifications, equivalences and alternative constructions falling within the spirit and scope of the invention as expressed in the appended claims.

Referring now to FIG. 1, there is illustrated in diagrammatic form a typical office building deck 10 and suspended grid 12. The grid 12 is suspended by a number of hanger wires such as the wire 14, and bracing wire, such as diagonal wires 15 and 17, and is usually about 24 inches from the deck. Mounted within the grid, which typically forms openings four feet by four feet, are acoustic panels and lighting fixtures neither of which is shown. Generally the grid is constructed of main runners, 10 to 12 feet long and cross tees of about 4 feet in length.

Figure 2:
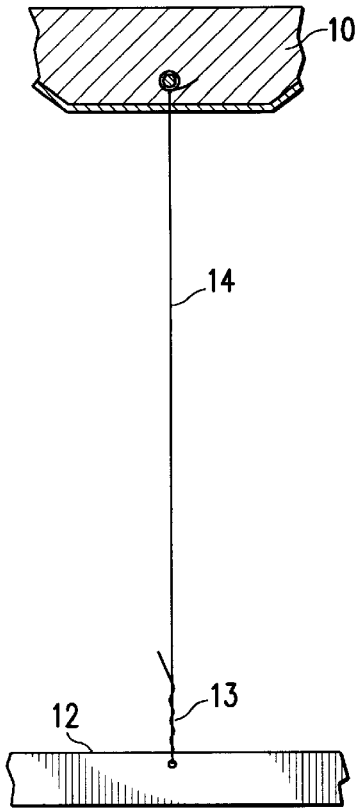
FIG. 2 is an enlarged partial elevational view showing the deck and grid broken away and a hanger wire connecting the grid to the deck.
Figure 3:
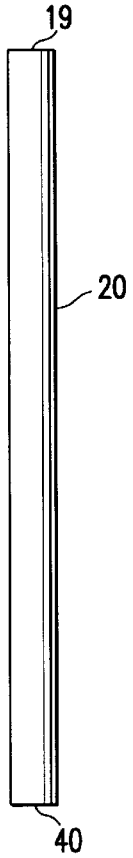
FIG. 3 is an elevational view of an elongated tube element.
Figure 4:
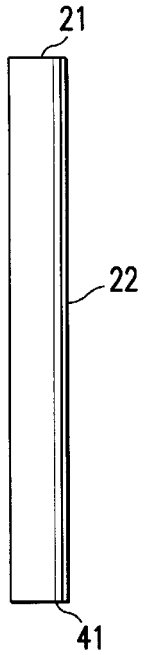
FIG. 4 is an elevational view of another elongated tube element.
Figure 6:
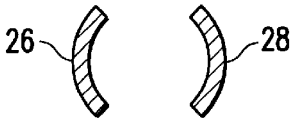
FIG. 6 is a sectional plan view taken along lines 6—6 of FIG. 5.
Figure 7:
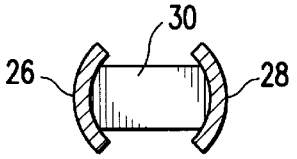
FIG. 7 is a sectional plan view taken along line 7—7 of FIG. 5.

Typically, the deck is formed of a metal base, reinforcing bars and poured concrete that covers the bars and is supported by the base. Also typically, the hanger wire 14 is wound around a reinforcing bar before it is covered with concrete. At its lower end, the hanger wire passes through a hole in the grid and is then twisted upon itself as shown in FIG. 2, the twist having the number 13. As may be appreciated, the hanging of the ceiling is relatively inexpensive, easy to do and may be done quickly.

It can now be appreciated that should an earthquake strike a building having such a suspended ceiling, the ceiling will be capable of moving vertically as well as swinging laterally under the influence of the energy generated by the earthquake.

Referring now to FIGS. 3, 4, 5, 6 and 7, the elements of the compression strut system of the present invention are shown. The system comprises an elongated tubular element 20 such as three-quarter inch diameter electric metallic tubing (EMT). This tube will be at least approximately six inches less than the vertical distance between the deck 10 and the grid 12. Generally, the length is about 18 inches but could be much longer or possibly shorter. The tubular element has a bottom end 40 and a top end 19. It is intended that the hanger wire 14, FIG. 2, will pass through the open center of the elongated tube 20. A second elongated tubular element, such as one inch diameter EMT tube 22 is also provided in a length between approximately twelve inches and up to half the distance between the deck 10 and the grid 12. This tube also has a bottom end 41 and a top end 21.

It is intended that the elongated tube 20 and the elongated tube 22 come together in a telescoping arrangement as will be described below in relation to FIGS. 8 and 9.

Figure 5:
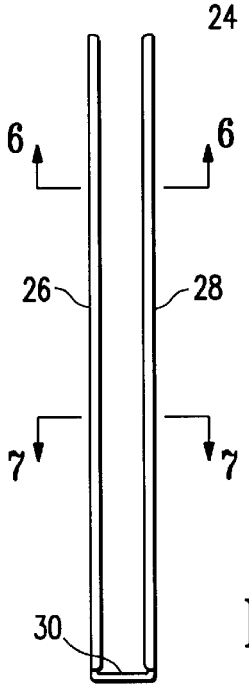
FIG. 5 is an elevational view of an adjustable locking connector.

A third element of the compression strut system is an adjustable locking connector 24, FIG. 5, comprising a strip of metal that is bent in a generally U shape having two arcuate shaped arms 26 and 28 connected at a base 30. The base 30 may have a reduced width to accommodate passage of the hanger wire to one side or the other of the base. It is contemplated that the adjustable locking connector will engage the two elongated tubes in a telescoping fashion and will function in two modes, a first mode where the legs 26 and 28 are extended as shown in FIG. 8 and a second mode where each of the legs is bent back upon itself as shown in FIG. 9.

The use of three-quarter inch EMT conduit for the elongated tube 20 and one inch EMT conduit for the elongated tube 22 is an example of using readily available material which is relatively inexpensive. It should be understood that the EMT conduit may also vary in size. For example, the elongated tube 20 may be of one inch EMT conduit and the elongated tube 22 may be of one and a quarter inch EMT conduit. Again, the one and a quarter inch conduit is readily available and relatively inexpensive.

Figure 8:
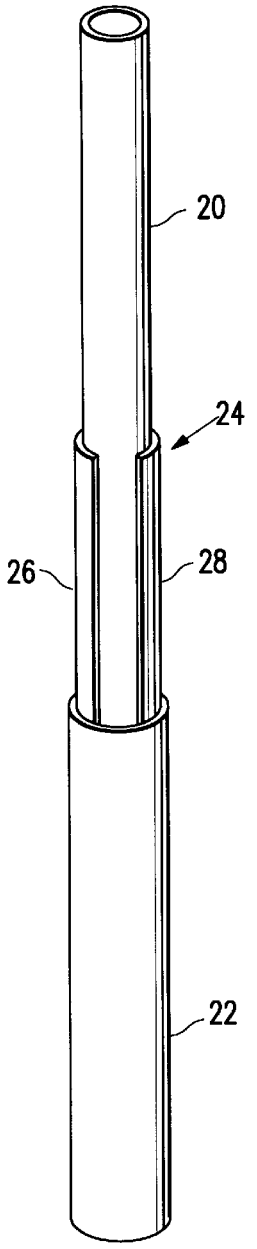
FIG. 8 is a prospective view of the functional relationship between the first and the second elongated tubes and the adjustable locking connector when the locking connector is in its adjustable mode.
Figure 9:
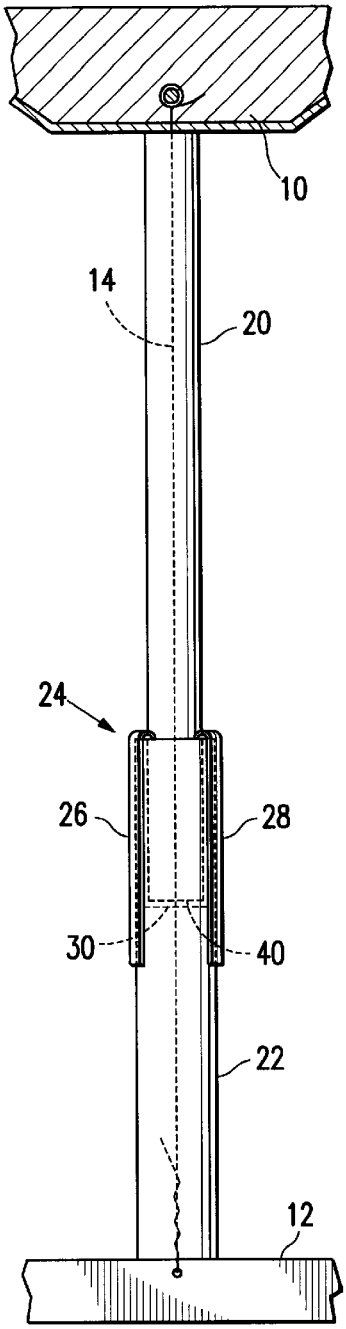
FIG. 9 is an elevational view of the first and the second tubular elements and of the connector in its locking mode.

The simplicity, ease of installation and the effectiveness of the present invention may be gathered by reference to FIGS. 8 and 9. There the telescoping arrangement of the three elements is illustrated. The smaller tube 20 is slipped over the hanger wire 14 followed by the adjustable locking connector 24. Thereafter, the larger diameter tube 22 is telescoped around both the smaller diameter tube and the adjustable locking connector. The larger tube 22 is moved upwardly causing the smaller tube to abut the deck at its top end 19 and the base 30 of the connector to abut the bottom end 40 of the smaller tube. This arrangement also keeps all of the pieces out of the way, by friction, while the wire is tied at the grid. Thereafter, the tube 22 is lowered to abut the grid at the tube's bottom end 41 while the connectors are held in place by the installer.

As shown in FIG. 9, the arms 26 and 28 may then be bent back on themselves around the top end 21 of the tube 22. When this occurs, the relative positions of the two tubes and the connector are fixed and a rigid post system is constructed between the deck and the grid. See FIG. 1 where the system is designated 32. Should an earthquake strike vertical movement of the grid is prevented. In tests conducted with prototype elements the system has withstood more than fifteen hundred pounds of compression.

In addition to eliminating bounce to the grid, the system will also restrict swaying motion because of the tubes' abutment with the deck at one end and the grid at the other end.

Figure 10:
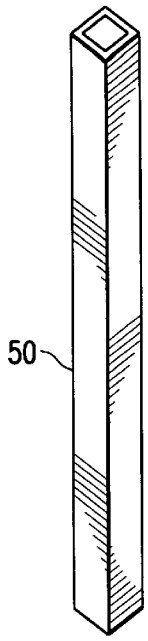
FIG. 10 is a prospective view of a variation of the first elongated element.
Figure 11:
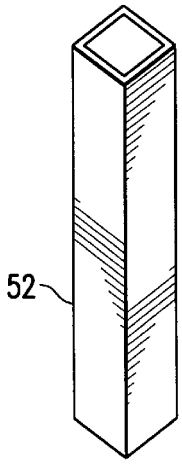
FIG. 11 is a prospective view of a variation of the second elongated element.

A variation of the tubes is shown is FIGS. 10 and 11 where the two elongated elements may comprise square tubes such as elongated tube 50 having the smaller dimension and elongated tube 52 having the larger dimension. Once again, square conduit is readily available and is relatively inexpensive.

Figure 12:
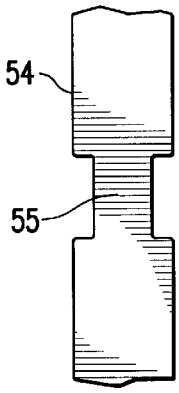
FIG. 12 is a partial plan view of a base for the adjustable locking connector.
Figure 13:
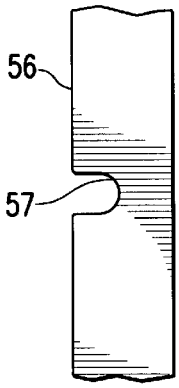
FIG. 13 is a partial plan view of a variation of the base for the adjustable locking connector.

Referring now to FIGS. 12 and 13, variations of the adjustable locking connector are shown. In FIG. 12, the locking connector 54 is a flat strip to operate with the square conduit 50 and 52. The base 55 is somewhat hour-glass shaped. The variation connector 56 in FIG. 13 shows a base having an indentation 57 only from one of its lateral edges to accommodate the wire. While the connectors 54 and 56 are shown as flat strips, the bases illustrated may be used with arcuate arms such as those shown on the connector 24, FIG. 5.

Figure 14:
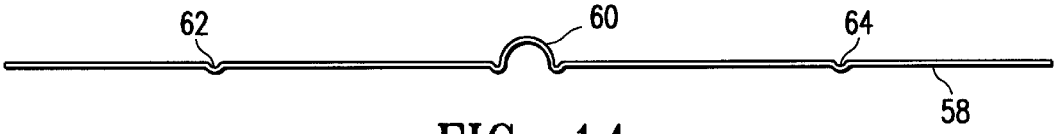
FIG. 14 is a elevational view of the adjustable locking connector in its "as manufactured" condition.

Referring now to FIG. 14, it is contemplated that the connector will be manufactured by a stamping operation, either as a flat strip such as the connectors 54 and 56, or with arcuate arms such as the connector 24. In any of the variations, a base 60 may be manufactured to have a bowed shape while the arms, such as an arm 58, extend away from one another. At the construction site an installer bends the arms in parallel alignment to one another. This generally reduces or straightens the bowed surface of the base 60. It is now evident that shipping connectors in the "unbent" shape of FIG. 14 is more efficient than shipping the same items bent in a U-shape.

The connector may also include indicators such as two small notches 62 and 64 (or alternatively, holes), one in each of the arms set about two inches from the extended ends of the connector to act as visual aids to the installer regarding where the arms may be bent. The bends should occur between the notches (or holes) and the ends of the connector.

It can now be appreciated that the system is simple and inexpensive and is very easy to use. The amount of extra time needed to install the system is minimal when compared to the advantages offers; therefore, the method described is very efficient.

I claim:

1. An acoustic ceiling compression strut system comprising:

a first elongated element having means for accommodating a wire;

a second elongated element having means for accommodating said first elongated element; and an adjustable connector operatable in two modes, a first mode whereby said first and said second elongated elements are movable relative to each other, and a second mode whereby said first and said second elongated elements are locked in position relative to one another;

said first elongated element is tubular in shape;

said second elongated element is tubular in shape;

said second elongated element is larger than said first elongated element;

said first elongated element is adapted to telescope within said second elongated element; and said connector is a strip having a U-shape with a base and two arms.

2. A system as claimed in claim 1 wherein:

said tubular elongated elements have generally square cross-sections.

3. A system as claimed in claim 2 wherein:

said tubular elongated elements are cylindrical.

4. A system as claimed in claim 3 wherein:

said two arms have arcuate shapes.

5. A system as claimed in claim 4 wherein:

said base of said connector has a reduced width.

6. A system as claimed in claim 5 wherein:

each of said arms of said connector has an indicator.

7. A system as claimed in claim 6 wherein:

each of said arms of said connector has a notch.

* * * * *